United States Patent [19]

Lord et al.

[11] 4,118,944

[45] Oct. 10, 1978

[54] HIGH PERFORMANCE HEAT EXCHANGER

[75] Inventors: Richard G. Lord, Liverpool; Rudy C. Bussjager, Minoa; David F. Geary, E. Syracuse, all of N.Y.

[73] Assignee: Carrier Corporation, Syracuse, N.Y.

[21] Appl. No.: 811,211

[22] Filed: Jun. 29, 1977

[51] Int. Cl.[2] ..... F25D 17/02; F28F 1/40; F15D 1/06

[52] U.S. Cl. ..... 62/98; 62/527; 138/38; 165/133; 165/179; 165/184

[58] Field of Search ..... 165/133, 179, 184; 62/98, 523, 527; 138/38

[56] References Cited

U.S. PATENT DOCUMENTS

| | | | |
|---|---|---|---|
| 2,279,548 | 4/1942 | Bailey | 165/179 X |
| 2,691,281 | 10/1954 | Phillips | 138/38 X |
| 2,913,009 | 11/1959 | Kuthe | 165/179 X |
| 3,088,494 | 5/1963 | Koch et al. | 165/179 X |
| 3,612,175 | 10/1971 | Ford | 138/38 |
| 3,786,653 | 1/1974 | Blomberg | 165/179 X |
| 4,044,797 | 8/1977 | Fujie et al. | 165/184 X |

*Primary Examiner*—Carlton R. Croyle
*Assistant Examiner*—Leonard E. Smith
*Attorney, Agent, or Firm*—J. Raymond Curtin; Robert P. Hayter

[57] ABSTRACT

Apparatus for and a method of operating a high performance shell and tube type heat exchanger utilizing tubes having integral internal fins. A specific tube circuit configuration is selected to limit the temperature drop of the refrigerant within the tube to a preselected range as the refrigerant flows through the circuit.

15 Claims, 5 Drawing Figures

HIGH PERFORMANCE HEAT EXCHANGER

BACKGROUND OF THE INVENTION

1. Field of the Invention

The present invention relates to heat exchange units which are adapted to have refrigerant flowing internally within a tube and simultaneously having the fluid to be cooled flowing externally over the same tube. More specifically, the present invention relates to high performance direct expansion coolers of the shell and tube type.

2. Description of the Prior Art

Heat exchangers of the shell and tube type have been commonly used for large commercial air conditioning and refrigeration applications wherein a circulating fluid typically water is cooled in the heat exchanger and thereafter circulated within the building to those specific areas where cooling is required. Often a shell and tube type heat exchanger is sold as a component of a packaged refrigeration unit having a conventional vapor compression refrigeration cycle. Therein refrigerant passes through a compressor where its temperature and pressure are increased and then proceeds to a condenser, where the refrigerant is cooled. From the condenser, the refrigerant flows through an expansion control device wherein the pressure of the refrigerant is decreased and finally the refrigerant flows to the shell and tube type heat exchanger wherein the liquid refrigerant changes state to a gaseous refrigerant absorbing heat from the liquid to be cooled in the process. Thereafter the gaseous refrigerant returns to the compressor where it is again compressed to commence the next cycle. Heat exchangers of the shell and tube type have also been sold separately within the refrigeration industry primarily as water chilling units in refrigeration machinery for commercial and business installations.

The typical direct expansion chiller or cooler has a multiplicity of parallel refrigerant carrying tubes mounted between headers communicating with inlet and outlet conduits within a cylindrical casing. The refrigerant is circulated through the tubes while the fluid to be cooled is circulated over the tubes. The refrigerant changes state within the tubes of the heat exchanger as it absorbs heat from the fluid to be cooled. The now cooled fluid may be circulated to meet the necessary cooling requirements of the installation. Previous heat exchangers have utilized copper or other material tubing with a smooth inner and outer surface more particularly referred to as prime surface tubes. Star shaped inserts have been available to create internal fins within the tubes, however, these have proved costly and have not been overwhelmingly accepted by the industry.

Tubes having integral helical internal fins have been known for sometime and are the subject of the following patents all by French, U.S. Pat. Nos. 3,422,518; 3,622,403; 3,622,582; 3,750,709; and 3,776,018. Other U.S. patents pertaining to metal tubes having internal fins include Laine; U.S. Pat. Nos. 511,900; Rieger, 3,768,291; Luca, 3,580,026; Issott; 3,118,328; Hill, 3,292,408; Koch, et al; 3,298,451; Nakamura, et al 3,830,087; Davis, 1,465,073; Lampart, 1,985,833; Diescher, 1,989,507; Hackett, 2,392,797; and Garand, 2,397,544.

Internal fin tubes have been commercially available for many years. Previous testing of these tubes in a typical shell and tube type exchanger has shown only minor improvement in overall unit efficiency. This prior testing was accomplished by substituting an internal fin tube for the existing smooth surface tube. It has now been discovered that efficient use of an internal finned tube requires a lesser temperature drop over the length of the tube circuit than the temperature drop over a standard smooth tube circuit. Furthermore, the internal finned tube shows negligible, if any, overall performance improvement when operated at the same temperature drop over the tube circuit as that of a smooth tube. Consequently to obtain the high efficiency desired from an internal finned tube it is necessary to select internal circuiting within the heat exchanger so that the temperature drop across the circuit is considerably less than across a similar circuit having smooth tubes.

It has further been found that the prior art internally finned tubes may be limited to a lead angle, that angle the fin makes with the axis of the tube, of approximately 15°. It has also been found that tube performance is enhanced if this angle is increased, in fact, the tube performance is maximized at angles considerably larger than 20°.

In order to make effective use of internal fin tubes it has been found necessary to both increase the lead angle of the internal fin and to operate the heat exchanger with a temperature drop over the refrigerant circuit that is much less than previously utilized. Observing the above conditions, it is possible with internal fin tubing to substantially increase the capacity of existing shell and tube type heat exchangers by changing the circuiting within the heat exchanger to result in the appropriate temperature drop and by changing the lead angle within the tubes to maximize their heat exchange efficiency. This increase in performance is accomplished with very little cost increase and with very little additional assembly time required.

SUMMARY OF THE INVENTION

An object of the invention is to operate a shell and tube type heat exchanger with high performance internal finned tubes such that the temperature drop across the refrigerant circuit is within a range to fully utilize the increased performance obtainable with internal fin tubes.

A more specific object of the present invention is to utilize an internal fin tube within a shell and tube type heat exchanger wherein said tube has a lead angle sufficient to optimize the tubes heat exchange coefficient.

A still further object of the invention is to provide apparatus and a method for making present shell and tube type heat exchangers more efficient and for increasing the capacity of these heat exchangers without substantially increasing the cost.

Other objects will be apparent from the description to follow and from the appended claims.

The preceding objects are achieved according to the preferred embodiment of the invention by providing a shell and tube type heat exchanger having a multiplicity of parallel internal fin tubes arranged in such a manner that the refrigerant circuit is the appropriate length so that the temperature drop of the refrigerant across the circuit does not exceed 50° F. and is optimally under full load conditions within the three to four degree range. Specifically this temperature drop range is provided for by decreasing the overall circuit length from that length used with smooth long tubes. An integral internal finned tube is utilized within the heat exchanger, said tube having a lead angle between the fins and the axis of the tube of at least 20° and optimally in the range of 20° to 45°. The combination of the internal fin tubing with the higher lead angle and the operation of the heat exchanger with the lower temperature drop across the circuit length act together to provide a highly efficient heat exchanger.

DESCRIPTION OF THE PREFERRED EMBODIMENT

The embodiment of the invention described below is adapted for use in a direct expansion heat exchanger although it is to be understood that the invention finds like applicability in other forms of heat exchanger units and other forms of use of integral finned tubes. The shell and tube type heat exchanger described hereafter is designed for use as the evaporator in the conventional direct expansion vapor compression refrigeration system. In such a system the compressor compresses gaseous refrigerant often R-11 (Trichloromorofluoromethane) or R-22 (dichlorodifluoromethane), which is then circulated through a condenser where it is cooled and liquified and then through an expansion control device to the low pressure side of the system. Upon flowing into the low pressure side of the system the refrigerant is evaporated within the shell and tube type heat exchanger as it absorbs heat from the fluid to be cooled changing phase from a partial liquid and partial vapor to a superheated vapor. The superheated vapor passes to the compressor to complete the cycle.

Figure 1:
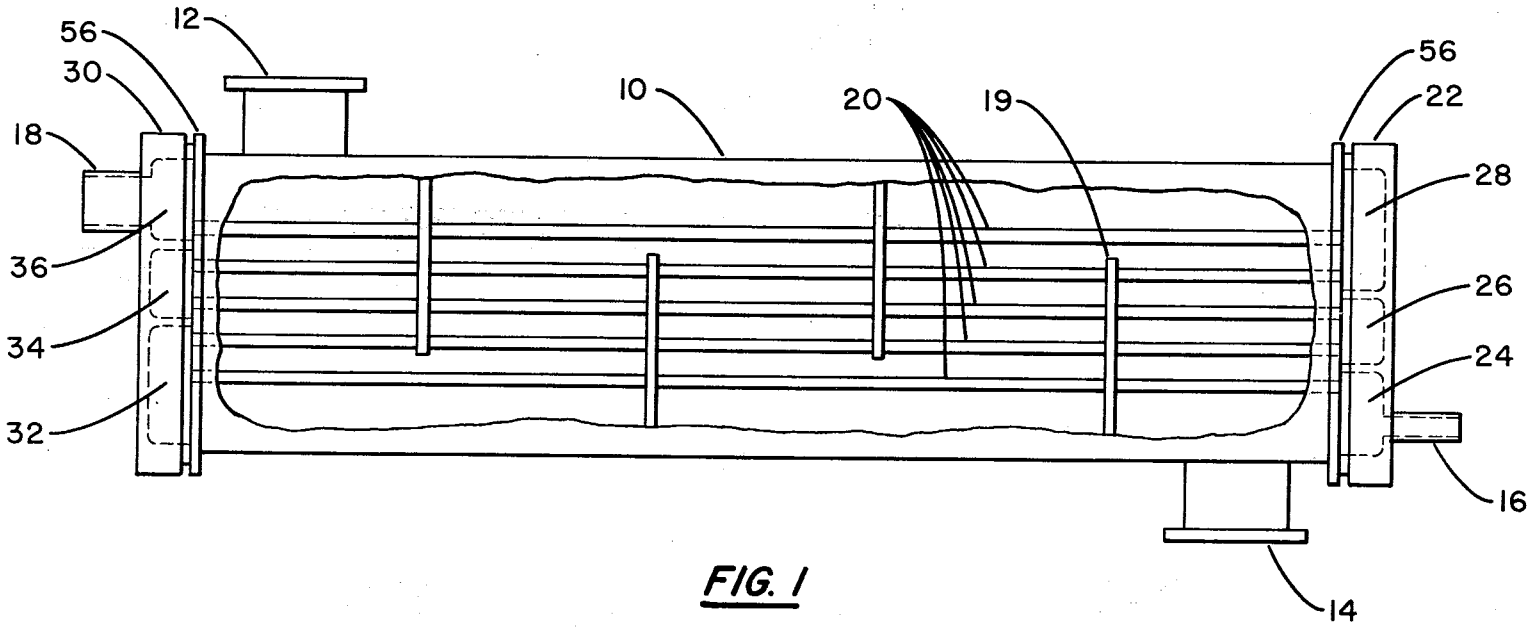
FIG. 1 is a partial elevational view of a shell and tube type heat exchanger.

Referring now to the drawings, FIG. 1 shows a partial elevational view a typical shell and tube type heat exchanger or chiller having a plurality of tubes 20. The tubes are mounted in tube sheets 56 at each end of the heat exchanger. Intermediate tube support is typically provided through the use of baffles which also serve to direct flow of the liquid tube cooled normal to the tube bundle in a repeating fashion. A fluid inlet 12 is provided in shell 10 for the entry of the fluid to be cooled, said fluid entering through inlet 12 passing over tubes 20 and then exiting the shell through fluid outlet 14. The fluid usually water, ethelyneglycol, seawater or other brine, as it passes through the heat exchanger is cooled by the refrigerant within the tubes 20.

Refrigerant inlet 16 connects the heat exchanger to the expansion control device (not shown) within the vapor compression refrigeration system. Refrigerant enters through inlet 16 to inlet header 22. As shown in FIG. 1 refrigerant then passes along a tube to the outlet header 30. Both headers are divided into compartments to route the refrigerant from one refrigerant pass of the heat exchanger to the next pass. The number of specific passes the refrigerant travels from one side of the heat exchanger to the other forms one circuit. For the sake of simplicity, only one tube circuit is shown in FIG. 1, however, the standard tube and shell type heat exchangers have many parallel circuits, the headers connecting each circuit at the various stages. Tube sheets 56 are provided at each end of the chiller shown in FIG. 1 to secure the tube ends. Baffles 19 are provided within the casing to support the tubes and to route the fluid to be cooled through the chiller.

More particularly the refrigerant from inlet header 22 enters from inlet nozzle 16 to the first inlet header compartment 24. From inlet compartment 24 the refrigerant proceeds through a tube to the first outlet compartment 32 then back through another tube and through second inlet compartment 26, then through a third tube to second outlet compartment 34, then through a fourth tube to third inlet compartment 28, and then through a fifth and final tube to third outlet compartment 36 and thereafter to refrigerant outlet 18 connected to the compressor (not shown) in the vapor compression system. The length of any particular circuit is determined by the length of the tubes in any given row between the headers, the distance traveled within the headers, and the number of tubes in the particular circuit.

Figure 2:
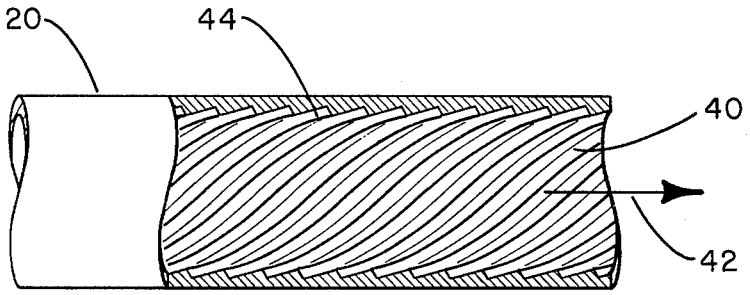
FIG. 2 is a cutaway elevational view of an internal integral finned tube.

FIG. 2 shows a cutaway view of an integral internal fin tube. As can be seen therein fins are formed on the interior surface of the tube at an angle between the direction of the fin and the axis 42 of the tube, said angle being referred to as the lead angle. Fins 44 are shown as forming lead angle 40 with axis 42.

Figure 3:
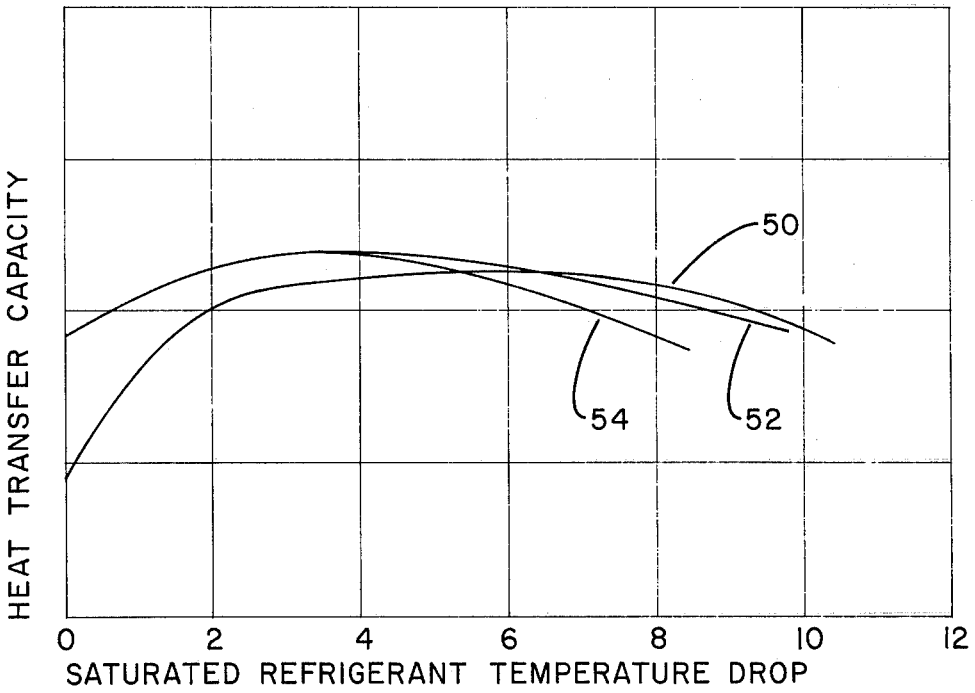
FIG. 3 is a graph of capacity in BTU's per hour vs. saturated refrigerant temperature drop over the circuit length for a smooth surface tube and for two internally finned tubes.

FIG. 3 is a graph showing the performance at various temperature drops of smooth surface tubes versus internally finned tubes. As can be seen on FIG. 3, line 50 representing the performance of a smooth surface tube as compared to the temperature drop across the circuit length, indicates that the peak performance for that tube is in the 7° F. temperature drop range. Curves 52 and 54 on FIG. 3 show the performance for two separate internal fin tubes wherein each have a maximum capacity at the 3 to 4 degree temperature drop range.

It is customary to design a shell and tube type heat exchanger so that the design temperature drop occurs under full load conditions. Whenever the unit is operated at less than full load, the temperature drop across the circuit will be less since less refrigerant is supplied to the circuit and consequently the velocity of the refrigerant is less. As can be seen from FIG. 3, the peak of the high performance tube at the 3 to 4 degree range is higher than the peak of the smooth tube at the 7 to 8 degree range. It can be further seen that when the unit is operating at a partial load condition that the performance of the integral finned tube is far superior to the smooth tube. Often at very light loads the unit may operate with as little as a half a degree temperature drop. At that particular temperature drop, FIG. 3 shows a broad distinction in performance between the internal fin tube and the smooth tube.

Figure 4:
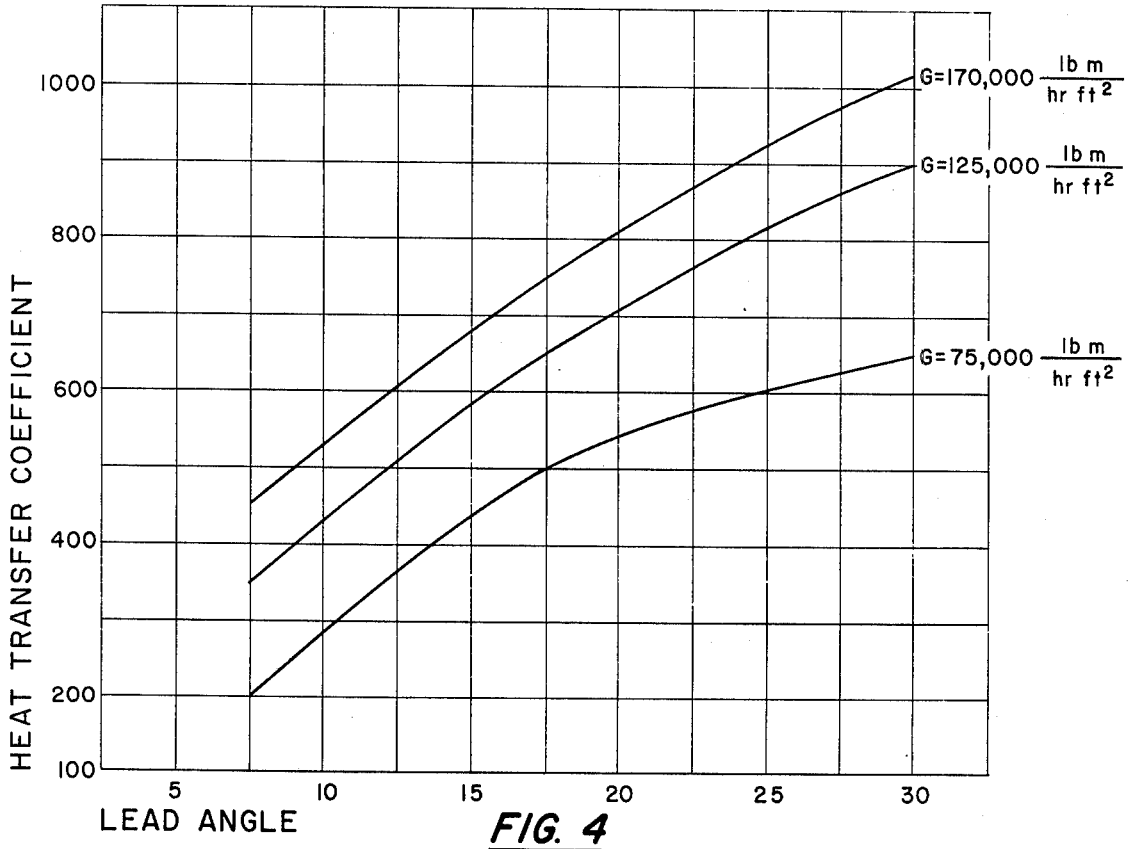
FIG. 4 is a graph of the average heat transfer coefficient of an internally finned tube vs. the lead angle of the fins in degrees.

Referring now to FIG. 4, it can be seen that the heat transfer coefficient of the tube varies with the lead angle of the fin within the tube. From the graph it is apparent that for achieving the maximum capacity from a given tube the lead angle of the fins should exceed 20°.

Figure 5:
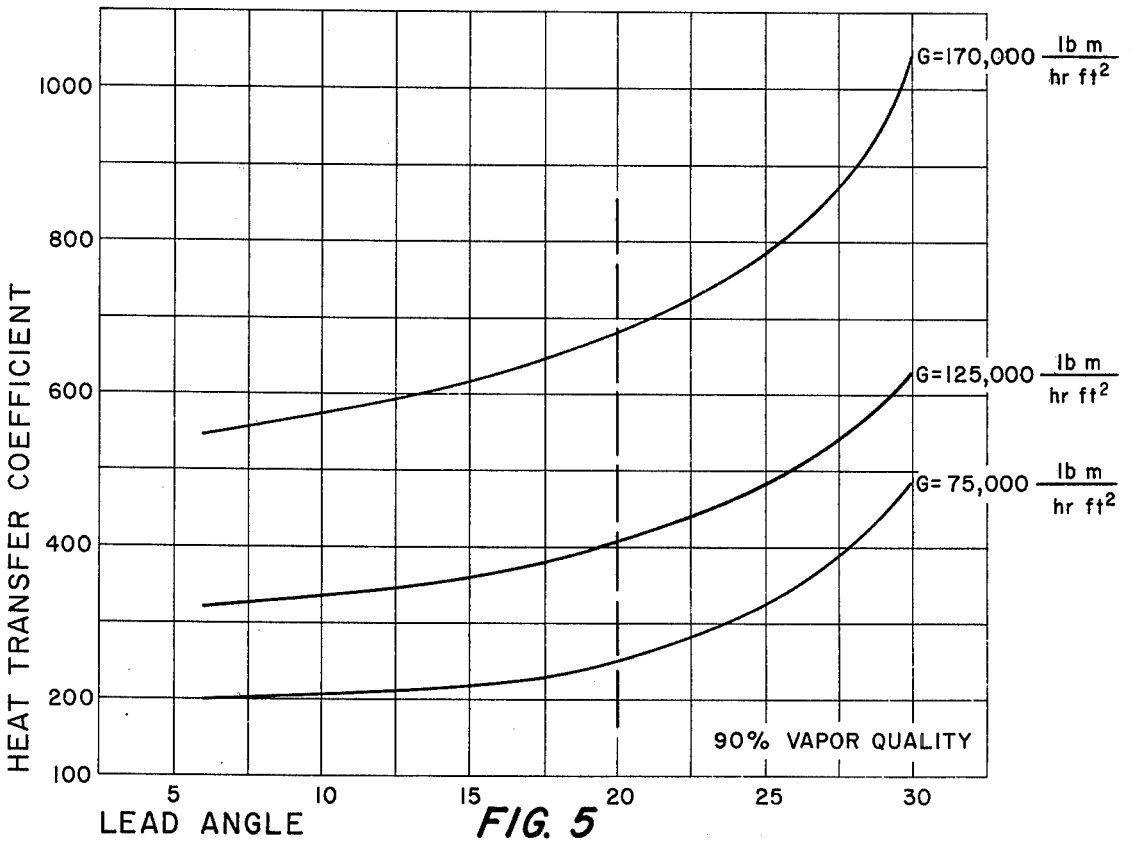
FIG. 5 is a graph of the heat transfer coefficient of an internally finned tube vs. the lead angle of the fins where the refrigerant within the tubes is at 90% vapor quality.

It is submitted that the refrigerant entering an internally finned tube with a lead angle exceeding 20° is swirled around the interior of the tube faster than when the tube has a lesser lead angle. The refrigerant enters a shell and tube type heat exchanger usually in two phases, a gaseous phase approximately 20 percent by weight and 80 percent by volume and a liquid phase approximately 20 percent by volume and 80 percent by weight. The swirling action imparted to the refrigerant mixture by the fins forces the liquid phase of the refrigerant to wet the entire tube surface resulting in a higher overall heat transfer coefficient between the refrigerant and the tube. Furthermore the fins provide additional surface area on the interior of the tube whereby more heat can be transferred from the tube. When a lesser lead angle fin is used the length along the tube which the refrigerant must travel before it completes a swirl within the tube is much more than when the lead angle is increased. By increasing the swirling effect the walls of the tube are wetted more evenly than with a lesser lead angle. Furthermore in the very high vapor quality regions of the heat exchanger, the minimal amount of liquid remaining is forced onto the tube surfaces and around the interior surface resulting in the tube surface being wetted more evenly reducing the area unwetted by the remaining liquid. Experimentally it has been shown that the high vapor quality regions of the tube are much increased in overall performance with internal finning. This increase in performance in high vapor quality regions is particularly useful because it allows for the refrigerant circuit to be completed without including one or two passes solely for superheating the refrigerant leaving additional tube length available for heat transfer in the more efficient higher vapor quality region. FIG. 5 shows an experimentally interpolated relationship between the heat transfer coefficient and the lead angle of the fins when the refrigerant is 90% vapor 10% liquid by weight. From this graph it can be seen that there is a marked improvement in heat transfer coefficient when the fin lead angle exceeds 20°.

It is theorized that the mechanism which results in the overall improved performance of the integral finned tube at a lesser temperature drop is a function of several factors. Generally, the rate of heat transfer from a heat exchanger element to another element is equal to the overall coefficient of heat transfer times the area of the surface times the temperature difference between the fluid from which the heat is being transferred to the fluid which is absorbing the heat. This relationship is typically set forth in the equation:

$$Q = A \times U \times \Delta T.$$

In the internal finned tube, the termperature drop is determined by the frictional losses which are a function of the refrigerant velocity to the squared power and the change in the heat transfer coefficient, a function of refrigerant velocity to the 0.8 power. Hence as the velocity is increased, the heat transfer coefficient H is increased to the 0.8 power. However, at the same time the $\Delta T$, the difference in temperature between the refrigerant and the fluid passing through the heat exchanger is decreased by the frictional losses within the tube. The graph shown in FIG. 3 depicts these two factors working together. It can be seen that at lower temperature drops the increase of the heat transfer coefficient controls and the overall capacity is increased as the temperature drop increases beginning from zero. As the temperature drop continues to increase, the velocity squared frictional loss factor begins to control and eventually produces a downward arc on the graph in the higher temperature drop ranges. By operating these high performance tubes in the lower ranges of the graph depicted in FIG. 3 it is possible to have the heat transfer coefficient as the primary factor therefore allowing for increased performance from the internal fin tube.

A result of operation at a lower circuit temperature drop is an increase in the average difference between the temperature of the refrigerant and the temperature of the liquid to be cooled. By increasing this difference ($\Delta T$) the heat transfer rate (Q) of the tube is increased.

The herein described invention teaches the use of high performance internal fin tubes within a shell and tube type heat exchanger and the optimum method of operating such a unit. It is within the scope and import of this invention to operate such apparatus as well as to construct internal fin tubes having appropriate lead angles to produce the results herein.

The invention has been described in detail with particular reference to a preferred embodiment thereof, but it will be understood that variations and modifications can be effected within the spirit and the scope of the invention.

What is claimed is:

1. A method of operating a cooler having a fluid which is cooled by a refrigerant which comprises:

passing the refrigerant through an internal integrally finned tube;

directing the fluid to be cooled in heat exchange relationship with the tube having the refrigerant flowing therethrough; and circuiting the refrigerant so that under full load conditions the temperature drop of the refrigerant within the tude does not exceed 5° F.

2. The method as set forth in claim 1 wherein the step of passing the refrigerant through a tube includes passing the refrigerant through a plurality of tubes forming a tube bundle.

3. The method as set forth in claim 1 wherein the step of circuiting the refrigerant includes the temperature drop of the refrigerant within the tube under full load conditions being within the range of 3° F. to 4° F.

4. The method as set forth in claim 1 and further including the step of:

forming the internal integral fin tube so that the internal fins are helical and the lead angle of the fins is 20° or greater.

5. The method as set forth in claim 4 wherein the step of forming includes having a fin lead angle in the range of 20° to 45°.

6. A method of operating an evaporator of a refrigeration system having a fluid which is cooled by a refrigerant which comprises:

passing the refrigerant through internal integrally finned tubing;

directing the fluid to be cooled in heat exchange relationship with the tubing having the refrigerant flowing therethrough;

transferring heat from the fluid to be cooled to the refrigerant; and circuiting the refrigerant so that when the refrigeration system is operated at full design load conditions, the temperature drop of the refrigerant within the tubing does not exceed 5° F.

7. The method as set forth in claim 6 wherein the step of circuiting the refrigerant includes the temperature drop of the refrigerant within the tubing at full design loading conditions being within the range of 3° F. to 4° F.

8. The method as set forth in claim 7 wherein the step of transferring includes changing the state of the refrigerant so that the refrigerant is entirely vapor at the completion of the step of circuiting.

9. The method as set forth in claim 6 and further including the step of:

forming the internal integral fin tubing so that the internal fins are helical in configuration and the lead angle of the fins is 20° or greater.

10. The method as set forth in claim 9 wherein the step of forming includes having a lead angle in the range of 20° to 45°.

11. A cooler for use in a refrigeration cycle having a fluid to be cooled by a refrigerant which comprises:

a tube having helical internal integral fins;

means for supplying the refrigerant to the tube;

means for receiving the refrigerant from the tube;

means for routing the refrigerant through the tube from the supplying means to the receiving means, each means for routing forming a separate flow circuit, such that the temperature drop at full load due to tube configuration does not exceed 5° F., and means for placing fluid to be cooled in heat exchange relationship with the refrigerant carrying tube whereby heat is transferred from the fluid to the refrigerant.

12. The invention as set forth in claim 11 wherein the lead angle of the fins in the tube is within the range of 20° to 45°.

13. The invention as set forth in claim 11 wherein the circuit length is such that the full load temperature drop is between 3° F. and 4° F.

14. The invention as set forth in claim 11 wherein a tube includes a tube bundle having a plurality of spaced tubes.

15. The invention as set forth in claim 14 wherein internal fin tubes are mounted parallel to each other and the means for placing the fluid to be cooled in heat exchange relationship with the tubes includes a casing enclosing the tube bundle through which the fluid to be cooled is passed.

* * * * *